US007422124B2

(12) United States Patent
Norris, Jr.

(10) Patent No.: US 7,422,124 B2
(45) Date of Patent: Sep. 9, 2008

(54) STACKING POCKET FOR DISPOSING AT A CORNER OF A ROOF OF A SHIPPING CONTAINER AND FOR HOLDING A CASTER WHEEL OF AN ABOVE-STACKED SHIPPING CONTAINER

(76) Inventor: William G. Norris, Jr., 13611 McQueens Ct., Jacksonville, FL (US) 32225

( * ) Notice: Subject to any disclaimer, the term of this patent is extended or adjusted under 35 U.S.C. 154(b) by 116 days.

(21) Appl. No.: 11/635,925

(22) Filed: Dec. 8, 2006

(65) Prior Publication Data

US 2007/0256953 A1 Nov. 8, 2007

Related U.S. Application Data

(60) Provisional application No. 60/798,069, filed on May 5, 2006.

(51) Int. Cl.
*B65D 88/00* (2006.01)

(52) U.S. Cl. ..... 220/1.5; 206/512

(58) Field of Classification Search ..... 220/1.5; 206/509, 511, 512; 248/129, 346.11; 211/194
See application file for complete search history.

(56) References Cited

U.S. PATENT DOCUMENTS 3,499,694 A * 3/1970 Coppell ..... 312/35
3,599,824 A * 8/1971 Pneuman et al. ..... 220/23.4
3,718,218 A * 2/1973 Shields ..... 220/23.2
4,101,144 A * 7/1978 Ross et al. ..... 280/441.2
4,809,851 A * 3/1989 Oestreich et al. ..... 206/599
5,383,639 A * 1/1995 Byard ..... 248/346.11
6,386,331 B2 * 5/2002 Scheffer ..... 188/32
2003/0089742 A1 * 5/2003 Fons ..... 222/185.1

* cited by examiner

*Primary Examiner*—Anthony D Stashick
*Assistant Examiner*—Harry A Grosso
(74) *Attorney, Agent, or Firm*—Charles E. Baxley

(57) ABSTRACT

A stacking pocket for disposing at a corner of a roof of a shipping container and for holding a caster wheel of an above-stacked shipping container. The pocket includes flat bars, a plate, and a wheel. The plate is triangular-shaped to substantially conform to the corner of the roof of the shipping container, attaches to the corner of the roof of the shipping container, and has a periphery. The flat bars are disposed in a truncated triangular configuration forming an open apex about the periphery of the plate, are attached to the plate, and hold the caster wheel of the above-stacked shipping container therebetween. The wheel is horizontally rotatably attached to the plate and is disposed at the open apex of the flat bars.

3 Claims, 1 Drawing Sheet

STACKING POCKET FOR DISPOSING AT A CORNER OF A ROOF OF A SHIPPING CONTAINER AND FOR HOLDING A CASTER WHEEL OF AN ABOVE-STACKED SHIPPING CONTAINER

CROSS REFERENCE TO RELATED APPLICATIONS

The instant non-provisional patent application claims priority from provisional patent application No. 60/798,069, filed on May 5, 2006, entitled STACKING FOR SHIPPING CONTAINERS, and which contains subject matter contained in application Ser. No. 11/155,074, filed on Jun. 16, 2005, published in U.S. 2006/0045682 A1, Mar. 2, 2006, entitled STORAGE UNIT FOR BEING PORTABLE, TOWABLE, LIFTABLE, RACKABLE, AND WEATHERPROOF, and both incorporated herein by reference thereto.

BACKGROUND OF THE INVENTION

A. Field of the Invention

The embodiments of the present invention relate to a stacking pocket, and more particularly, the embodiments of the present invention relate to a stacking pocket for disposing at a corner of a roof of a shipping container and for holding a caster wheel of an above-stacked shipping container.

B. Description of the Prior Art

Due to the cost associated with shipping goods not only locally but long distance—including internationally—and due to the need to standardize the manner in which freight is warehoused or shipped, many goods are transported in large metallic shipping containers. The shipping containers are conventionally loaded and unloaded with respect to a transport vehicle by the use of forklifts or cranes raising and lowering the containers relative to the supporting deck or bed of the transporting vehicle.

It is well known in the cargo container art that for convenience of loading a container and strength of mounting, doors for the container are located at and form a rear wall surface of the container in use. The cargo container itself is constructed of a rectangular framework supporting a top, a bottom, side walls, and a front wall, and the doors are pivotally mounted on elongate posts located at each corner at the rear of the container to define part of the rear wall. The two opposed rear corner posts extend in a vertical direction and are provided at each of the opposed ends thereof, respectively, with a standard ISO corner casting for attaching the container to lifting equipment or for stacking the container relative to other containers—one upon the other. It is usual with these cargo containers to load them with pallets containing the articles to be transported.

Moving into an open position, the doors are swung completely outside the door frame opening as defined between the top rail, bottom rail, and corner posts interconnecting the top and bottom rails. Each door has a seal around its outermost edge. Shipping systems have been developed allowing shipping containers to be unloaded from the transporting vehicle at a point of delivery or at a point of loading until the container is ready for further shipment.

Numerous innovations for storage units and related devices have been provided in the prior art, which will be discussed below in chronological order to show advancement in the art, and which are incorporated herein by reference thereto. Even though these innovations may be suitable for the specific individual purposes to which they address, they each differ in structure, and/or operation, and/or purpose from the embodiments of the present invention in that they do not teach a stacking pocket for disposing at a corner of a roof of a shipping container and for holding a caster wheel of an above-stacked shipping container.

(1) United States Patent Publication Number 2003/0089742 to Fons.

United States Patent Publication Number 2003/0089742 to Fons teaches a bin of corrosion-resistant material fitted inside a steel container. The bin is fastened to the container walls. The side walls and the top wall of the bin are substantially identical in shape to those of the steel container. The container is intended for transport of bulk goods, especially plastic particle material, the contamination of this material by steel particles, which have come loose as a result of corrosion, being prevented.

(2) U.S. Pat. No. 3,599,824 to Pneuman.

U.S. Pat. No. 3,599,824 to Pneuman teaches a coupling device for interconnecting cargo containers having pairs of spaced oppositely disposed lugs thereon. The coupling device is interengaged with and between the lugs of the containers, and is particularly adapted for rigidly interconnecting a pair of spaced mutually aligned modular USASI/ISO or similar cargo containers having standard hallow slotted fittings in the opposing corners thereof, in which case the device is interposed between each pair of opposing corner fittings and interengaged with and between opposing edge portions of the slotted end openings in the fittings.

(3) U.S. Pat. No. 3,718,218 to Shields.

U.S. Pat. No. 3,718,218 to Shields teaches a horizontal connection between at least two adjacent stacks of vertically stacked cargo containers having apparatus between the containers in each stack positioning, aligning, and interlocking these containers. A horizontal stack interlock member is disposed on top of at least one container in each stack at like stack elevations and is releasably secured to its supporting container. The interlocking member is rotatable about a vertical axis through a limited arc and includes at least one protrusion for horizontal alignment with the protrusion in the interlocking member on the adjacent container stack. A rigid toothed rack between the two members engages the protrusions and thereby horizontally interlocks the containers in the adjacent stacks. By rotating the interlocking members through the vertical axes, the toothed rack is released from the protrusions to break the connection between the stacks.

(4) U.S. Pat. No. 3,737,061 to Glumac.

U.S. Pat. No. 3,737,061 to Glumac teaches a truck trailer body having liftable features and a removable storage unit for transport thereby.

(5) U.S. Pat. No. 4,101,144 to Ross et al.

U.S. Pat. No. 4,101,144 to Ross et al. teaches a trailer having a rear central guide post and primary rear load carrying wheels that can be elevated to transfer ground contact to caster wheels and lower the trailer bed, so that the trailer can be readily maneuvered while the trailer is backed on the caster wheels to assist in properly aligning the trailer beneath a leg-mounted pallet frame for containers having a center guide slot for receiving the guide post, whereupon the primary wheels are lowered to lift the pallet frame free of the ground for transport on the trailer.

(6) U.S. Pat. No. 4,266,900 to Rynyk.

U.S. Pat. No. 4,266,900 to Rynyk teaches a material handling apparatus, for example, for delivering bags of garbage to an incinerator. The apparatus includes a plurality of material-receiving compartments, each having a first end at which material can be loaded into the compartment, and a second end from which material can be discharged. Each compartment includes a belt conveyor forming a bottom wall of the compartment and which is operable to move material longitudinally of the compartment in a direction towards the second end. Side walls of the compartment extend upwardly adjacent respective opposite sides of the conveyor for laterally constraining material in the compartment. The compartment also includes closure apparatus normally preventing discharge of material from the second end of the compartment. The closure apparatus is adapted to be opened at appropriate times to allow material to be discharged from the compartment by operating the belt conveyor. The apparatus also includes a further belt conveyor positioned to receive material discharged from the compartments and operable to deliver the material to a common discharge location.

(7) U.S. Pat. No. 4,747,504 to Wiseman et al.

U.S. Pat. No. 4,747,504 to Wiseman et al. teaches an aircraft cargo container having sides, inboard and outboard ends, a horizontal top, and a horizontal bottom. The bottom is rectangular and provided with casters located in corner recesses. The inboard end and both sides of the container are substantially vertical, while the outboard end substantially conforms to the curvature of the aircraft fuselage cabin cross section. The inboard and outboard ends are so sized that the container will freely pass through a standard left side passenger entry door. The sides are so dimensioned that when two containers are located end-to-end with their inboard ends opposed, they will substantially fill the aircraft fuselage cabin cross section with clearance between themselves and between themselves and the aircraft fuselage, so that a plurality of containers can be arranged within the aircraft in two longitudinal rows. The containers of each row have adjacent sides opposed. Each container has a door in one of its sides. The container bottom provides flanges along the container ends cooperating with side guide rails and a center guide rail assembly mounted in the aircraft. The container bottom also provides flanges along the container sides, which are engageable by fore and aft restraints.

(8) U.S. Pat. No. 4,875,595 to Van Valkenburg.

U.S. Pat. No. 4,875,595 to Van Valkenburg teaches a storage enclosure for storing containers of hazardous material with a secondary containment feature being provided by a one-piece containment pan cradled within a support base framework of support beams and side beams also allowing for visual inspection of the underside of the pan. The enclosure is of a very sturdy construction employing relatively heavy gauge steel sheets for side and rear wall panels mounted to panel-supporting frames of tubular-steel frame members. A pair of front doors are also made of steel panels secured to door frames of tubular-steel construction. Footing channel members provide spaces for forklift mobility of the enclosure. The one-piece panel roof and associated frame is secured by a friction fit to the enclosure side walls, so that it may lift off when elevated internal pressures are experienced.

(9) U.S. Pat. No. 4,884,722 to Podd.

U.S. Pat. No. 4,884,722 to Podd teaches a bulkhead for use with a cargo container, including a wall member and at least a first slanted corner member. The wall member holds cargo in the container, and the corner member is connected to the wall member adjacent a lower corner thereof to guide cargo downwardly and laterally toward an outlet in the wall member. Also, there is a lining system for a cargo container, including a flexible liner and a bulkhead to hold the liner in place in the container. The liner includes an inlet and an outlet. Collapsible inlet and outlet chutes selectively open and close the inlet and outlet of the liner. With one embodiment, the lining system is air and water tight, and with an alternate embodiment, the liner allows gases to pass outward therethrough.

(10) U.S. Pat. No. 6,401,983 to McDonald et al.

U.S. Pat. No. 6,401,983 to McDonald et al. teaches a bulk cargo container for storing, transporting, or processing solid or liquid bulk materials. The bulk cargo container includes a vessel suitable for containing the bulk material and a supporting frame assembly having a generally horizontally disposed support member attachment. In an exemplary embodiment, the vessel is formed of fiber reinforced plastic material and includes a container portion and a support member. The container portion is formed into at least one hopper having a discharge opening therein suitable for discharging bulk material contained within the vessel. The vessel is supported from the support member attachment via the support member, so that the weight of the bulk material is carried in tension by the fiber reinforced plastic material of the vessels shell.

(11) U.S. Pat. No. 6,443,209 to Hurst.

U.S. Pat. No. 6,443,209 to Hurst teaches a roll-up door for trucks and the like, including a one-piece plastic sheet member enclosing the door opening. A plurality of stiffening panels are attached to the sheet member in spaced relation and preferably bonded to the sheet member. Rollers and attached axles are mounted on the panels via bores receiving the axles. The rollers ride in roll-up door tracks capturing the rollers and door to the tracks in conventional fashion. The sheet member forms living hinges in the spaces between adjacent panels.

It is apparent that numerous innovations for storage units and related devices have been provided in the prior art that are adapted to be used. Furthermore, even though these innovations may be suitable for the specific individual purposes to which they address, they would not be suitable for the purposes of the embodiments of the present invention as heretofore described, namely, a stacking pocket for disposing at a corner of a roof of a shipping container and for holding a caster wheel of an above-stacked shipping container.

SUMMARY OF THE INVENTION

Thus, an object of the embodiments of the present invention is to provide a stacking pocket for disposing at a corner of a roof of a shipping container and for holding a caster wheel of an above-stacked shipping container that avoids the disadvantages of the prior art.

Briefly stated, another object of the embodiments of the present invention is to provide a stacking pocket for disposing at a corner of a roof of a shipping container and for holding a caster wheel of an above-stacked shipping container. The pocket includes flat bars, a plate, and a wheel. The plate is triangular-shaped to substantially conform to the corner of the roof of the shipping container, attaches to the corner of the roof of the shipping container, and has a periphery. The flat bars are disposed in a truncated triangular configuration forming an open apex about the periphery of the plate, are attached to the plate, and hold the caster wheel of the above-stacked shipping container therebetween. The wheel is horizontally rotatably attached to the plate and is disposed at the open apex of the flat bars.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

BRIEF DESCRIPTION OF THE DRAWING

The sole FIGURE of the drawing is a diagrammatic perspective view of the stacking pocket of the embodiments of the present invention disposed at a corner of a roof of a shipping container.

LIST OF REFERENCE NUMERALS UTILIZED IN THE DRAWING

Figure 1:
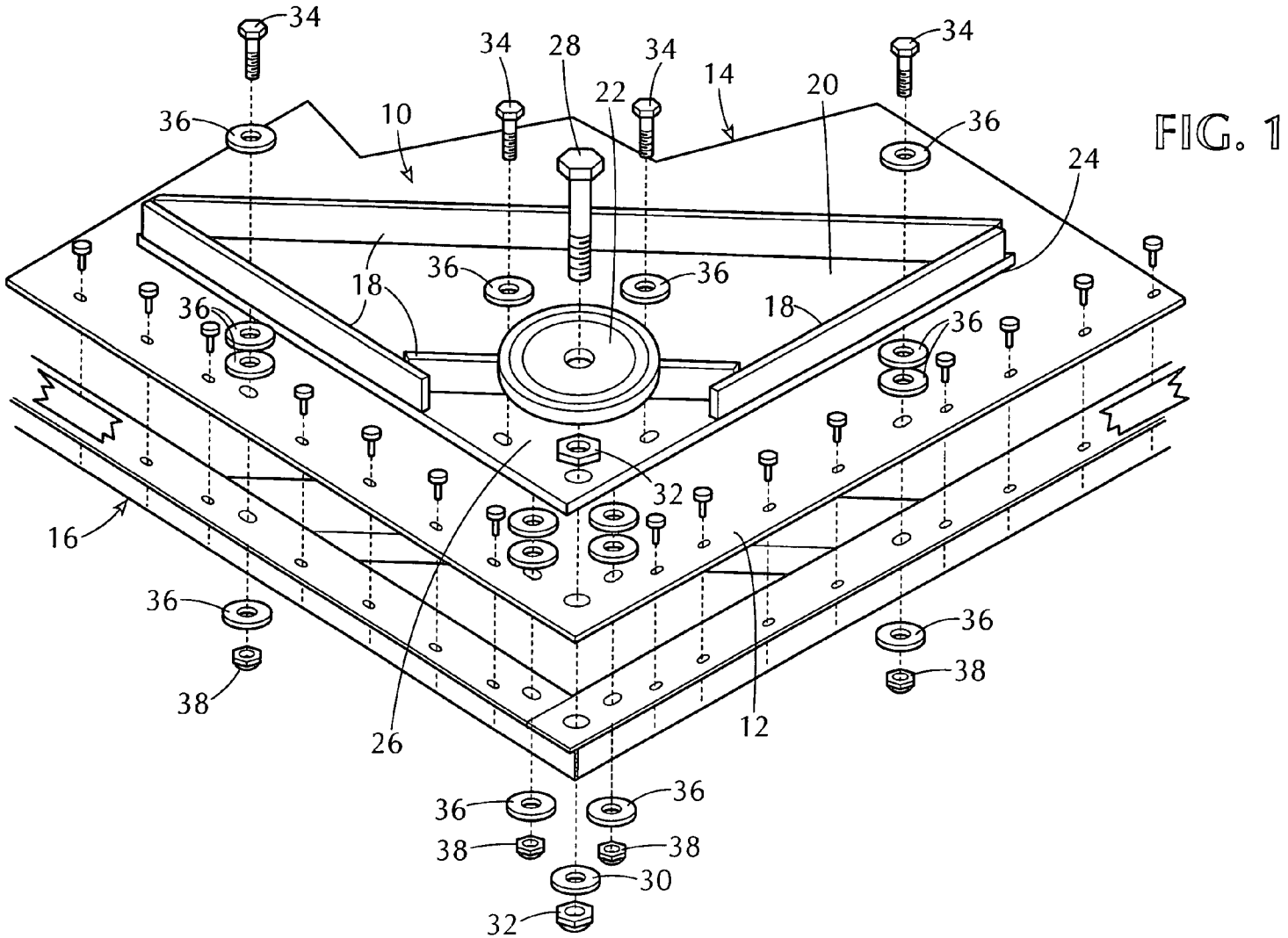

A. General.

10 stacking pocket of embodiments of present invention for disposing at corner 12 of roof 14 of shipping container 16 and for holding a caster wheel (not shown) of above-stacked shipping container (not shown)

12 corner of roof 14 of shipping container 16

14 roof of shipping container 16

16 shipping container

B. Configuration of Stacking Pocket 10.

18 flat bars

20 plate for substantially conforming to and attaching at corner 12 of roof 14 of shipping container 16

22 wheel

24 periphery of plate 20

26 open apex of flat bars 18

28 first bolt

30 first washer

32 first nuts

34 second bolts for attaching plate 20 to corner 12 of roof 14 of shipping container 16

36 second washers for attaching plate 20 to corner 12 of roof 14 of shipping container 16

38 second nuts for attaching plate 20 to corner 12 of roof 14 of shipping container 16

DETAILED DESCRIPTION OF THE PREFERRED EMBODIMENTS

A. General.

Referring now to the sole figure, in which like numerals indicate like parts, and which is a diagrammatic perspective view of the stacking pocket of the embodiments of the present invention disposed at a corner of a roof of a shipping container, the stacking pocket of the embodiments of the present invention is shown generally at 10 for disposing at a corner 12 of a roof 14 of a shipping container 16 and for holding a caster wheel (not shown) of an above-stacked shipping container (not shown).

B. The Configuration of the Stacking Pocket 10.

The stacking pocket 10 comprises flat bars 18, a plate 20, and a wheel 22. The plate 20 is triangular-shaped for substantially conforming to the corner 12 of the roof 14 of the shipping container 16, is for attaching to the corner 12 of the roof 14 of the shipping container 16, and has a periphery 24. The flat bars 18 are disposed in a truncated triangular configuration forming an open apex 26 about the periphery 24 of the plate 20 and are attached to the plate 20. The truncated triangular configuration of the flat bars 18 are for holding the caster wheel (not shown) of the above-stacked shipping container (not shown) therein. The wheel 22 is horizontally rotatably attached to the plate 20 and is disposed at the open apex 24 of the flat bars 18.

The stacking pocket 10 further comprises a first bolt 28, a first washer 30, and first nuts 32. The wheel 22 is horizontally rotatably attached to the plate 20 by the first bolt 28, the first washer 30, and the first nuts 32.

The stacking pocket 10 further comprises second bolts 34, second washers 36, and second nuts 38. The second bolts 34, the second washers 36, and the second nuts 38 are for attaching the plate 20 to the corner 12 of the roof 14 of the shipping container 16.

C. The Conclusions.

It will be understood that each of the elements described above or two or more together may also find a useful application in other types of constructions differing from the types described above.

While the embodiments of the present invention have been illustrated and described as embodied in a stacking pocket for disposing at a corner of a roof of a shipping container and for holding a caster wheel of an above-stacked shipping container, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt it for various applications without omitting features that from the standpoint of prior art fairly constitute characteristics of the generic or specific aspects of the embodiments of the present invention.

The invention claimed is:

1. A stacking pocket for disposing at a corner of a roof of a shipping container and for holding a caster wheel of an above-stacked shipping container, comprising:

a) flat bars;

b) a plate; and c) a wheel;

wherein said plate is triangular-shaped for substantially conforming to the corner of the roof of the shipping container;

wherein said plate is for attaching at the corner of the roof of the shipping container;

wherein said plate has a periphery;

wherein said flat bars are disposed in a truncated triangular configuration forming an open apex about said periphery of said plate;

wherein said flat bars are attached to said plate;

wherein said truncated triangular configuration of said flat bars is for holding the caster wheel of the above-stacked shipping container therein;

wherein said wheel is horizontally rotatably attached to said plate; and wherein said wheel is disposed at said open apex of said flat bars.

2. The pocket of claim 1, further comprising:

a) a first bolt;

b) a first washer; and c) first nuts;

wherein said wheel is horizontally rotatably attached to said plate by said first bolt, said first washer, and said first nuts.

3. The pocket of claim 1, further comprising:

a) second bolts;

b) second washers; and c) second nuts;

wherein said second bolts, said second washers, and said second nuts are for attaching said plate to the corner of the roof of the shipping container.

* * * * *